US012471653B2

(12) United States Patent
Larian

(10) Patent No.: US 12,471,653 B2
(45) Date of Patent: Nov. 18, 2025

(54) GARMENT SUSPENDER

(71) Applicant: Bujii LLC, Los Angeles, CA (US)

(72) Inventor: Lisa Larian, Los Angeles, CA (US)

( * ) Notice: Subject to any disclaimer, the term of this patent is extended or adjusted under 35 U.S.C. 154(b) by 11 days.

(21) Appl. No.: 17/947,693

(22) Filed: Sep. 19, 2022

(65) Prior Publication Data

US 2024/0090606 A1 Mar. 21, 2024

(51) Int. Cl.

| | |
|---|---|
| ***A41F 3/00*** | (2006.01) |
| *A41F 3/02* | (2006.01) |
| *A41F 3/04* | (2006.01) |
| *A41F 5/00* | (2006.01) |
| *A41F 11/02* | (2006.01) |
| *A41F 11/04* | (2006.01) |
| *A41F 11/06* | (2006.01) |
| *A41F 11/08* | (2006.01) |
| *A41F 11/14* | (2006.01) |
| *A41F 15/00* | (2006.01) |
| *A41F 15/02* | (2006.01) |

(52) U.S. Cl.

CPC ..... *A41F 3/00* (2013.01); *A41F 3/02* (2013.01); *A41F 3/04* (2013.01); *A41F 5/00* (2013.01); *A41F 11/02* (2013.01); *A41F 11/04* (2013.01); *A41F 11/06* (2013.01); *A41F 11/08* (2013.01); *A41F 11/14* (2013.01); *A41F 15/00* (2013.01); *A41F 15/002* (2013.01); *A41F 15/02* (2013.01)

(58) Field of Classification Search

CPC ..... A41F 3/00; A41F 3/02; A41F 3/04; A41F 11/02; A41F 11/04; A41F 11/06; A41F 11/08; A41F 11/14; A41F 15/00; A41F 15/002; A41F 15/02; A41F 5/00

USPC ..... 2/340

See application file for complete search history.

(56) References Cited

U.S. PATENT DOCUMENTS

| | | | | | |
|---|---|---|---|---|---|
| 2,452,538 | A * | 11/1948 | Ashton | A41F 3/00 | 2/325 |
| 3,982,547 | A * | 9/1976 | Walker | A41C 3/00 | 450/86 |
| 4,202,343 | A * | 5/1980 | Ichelson | A41C 3/0057 | 450/14 |
| 5,149,293 | A * | 9/1992 | Gable | A44B 11/04 | 2/101 |
| 5,560,045 | A * | 10/1996 | Rockefeller | A41F 3/02 | 2/327 |
| 5,623,735 | A | 4/1997 | Perry | | |
| 6,106,130 | A * | 8/2000 | Harding | G08B 5/004 | 362/108 |
| 6,804,834 | B1 | 10/2004 | Mok | | |
| 11,497,265 | B2 * | 11/2022 | Wenkman | A41F 9/007 | |

(Continued)

*Primary Examiner* — Khaled Annis
*Assistant Examiner* — Dakota Marin
(74) *Attorney, Agent, or Firm* — Omni Legal Group; Omid E. Khalifeh; Ariana Santoro

(57) ABSTRACT

A garment suspender and system is provided. The garment suspender may comprise at least one strap configured to connect a first garment to a second garment. The at least one strap may comprise a first end and a second end. A first clip may be disposed at the first end and a second clip may be disposed at the second end such that the first clip and the second clip may secure the second garment so as to form-fit a body of at least one wearer. The at least one strap may be removably or permanently affixed to or convertibly overlay the first garment. The first clip and the second clip may be suspender clips and the at least one strap may be formed of elastic.

9 Claims, 10 Drawing Sheets

(56) References Cited

U.S. PATENT DOCUMENTS

| | | | | |
|---|---|---|---|---|
| 2004/0184262 | A1* | 9/2004 | De Silva | G08B 5/004 362/108 |
| 2007/0256216 | A1 | 11/2007 | Margiotta et al. | |
| 2011/0197335 | A1* | 8/2011 | Handy | A41F 5/00 2/117 |
| 2012/0090078 | A1* | 4/2012 | von Olnhausen | A41C 3/08 2/326 |
| 2013/0091621 | A1* | 4/2013 | Lu | A41F 3/00 2/326 |

* cited by examiner

GARMENT SUSPENDER

GOVERNMENT CONTRACT

Not applicable.

CROSS-REFERENCE TO RELATED APPLICATIONS

Not applicable.

STATEMENT RE. FEDERALLY SPONSORED RESEARCH/DEVELOPMENT

Not applicable.

COPYRIGHT & TRADEMARK NOTICES

A portion of the disclosure of this patent document may contain material which is subject to copyright protection. This patent document may show and/or describe matter which is or may become trade dress of the owner. The copyright and trade dress owner has no objection to the facsimile reproduction by any one of the patent document or the patent disclosure, as it appears in the Patent and Trademark Office patent files or records, but otherwise reserves all copyrights and trade dress rights whatsoever.

TECHNICAL FIELD

The disclosed subject matter relates generally to garment suspender devices and systems and, more particularly, to a garment suspender wherein at least one strap having at least two clips connects a garment top and a garment bottom so as to make the garment more flattering and increase the range of body sizes capable of wearing the garment.

BACKGROUND

For centuries, people have been experimenting with various garments for practical reasons, such as the need for warmth, and recreational reasons, such as an interest in fashion. For the same amount of time, individuals have struggled with the need for sizing adaptability and the desire to make garments more flattering. Women's clothing can often be particularly constraining in that many garments fail to suit all body types. Thus, there exists a need for more sizing diversity within a single-sized garment, more form-fitting and flattering garments, and inherently, an increased likelihood of sale of garments.

Efforts have been made to address some of these concerns but ultimately, none boast the same advantages of the present invention. For example, U.S. Pat. No. 5,623,735 to Perry teaches a pair of suspenders to be worn with a belt. This example is narrowly limited to use with pants having belt loops and a belt and lacks adaptability to other style garment bottoms. There exists a need for suspenders that can be worn with virtually any garment bottom or at least, garment bottoms other than pants with belt loops.

Another effort is understood with reference to U.S. Pat. No. 6,804,834 to Mok, which discloses a suspender set intended to be worn with a belt and under a person's shirt. Again, this suspender set requires the person to wear a belt. In addition, these suspenders are concealed under the wearer's garments. There exists a need for suspenders that are not concealed but instead, incorporated into the design of the garment.

U.S. Patent Application Publication No. 2007/0256216 to Kronen illustrates a third example of suspenders for supporting women's maternity and non-maternity clothes. This disclosure has the benefit of adapting a wider range of garments, including maternity and non-maternity, to pregnant women's changing bodies. However, this teaching is unique to pregnant women's bodies and therefore, is not adaptable to a broader range of body types. Further, these suspenders are attached to a woman's bra and lower garment along the sides of her body. As a result, there remains a need for fashionable suspenders that are visibly incorporated into the garment's design.

SUMMARY

The present disclosure is directed to a garment suspender configured to appear as part of the design of a first garment, such as a garment top. The garment suspender may comprise at least one strap having a first end and a second end. The at least one strap may connect the first garment to a second garment. Throughout this disclosure, the first garment may be illustrated as the garment top. However, it will be understood that in other embodiments, the first garment may comprise a garment bottom and the second garment may comprise footwear, such as socks. Overall, the first garment may be depicted in relation to the second garment but neither the first garment nor the second garment may be limited.

For purposes of summarizing, certain aspects, advantages, and novel features have been described. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested.

In accordance with one embodiment, the garment suspender may also comprise a first clip disposed at the first end of the at least one strap and a second clip disposed at the second end of the at least one strap. In further embodiments, the garment suspender may also comprise a third end and a fourth end that may be affixed to the first garment. In some of these embodiments, the third end and the fourth end may be permanently affixed to the first garment so as to be incorporated into the design of the first garment. In other embodiments, the at least one strap may convertibly overlay the first garment, that is, the at least one strap may remain unaffixed to the first garment.

The first clip and the second clip may comprise any fastening means suitable to connect the first garment to the second garment in a form-fitting manner. Indeed, the first garment may be connected to the second garment so as to flatter a body of at least one wearer. In accordance with certain embodiments, the first clip and the second clip may comprise suspender or pacifier clips (hereafter referred to as "suspender clips").

While in some embodiments, the at least one strap may comprise a single strap, in others, the at least one strap may comprise a plurality of straps. For instance, the at least one strap may comprise a first strap and a second strap. In some of these embodiments, the first strap and the second strap may be parallelly disposed along a first shoulder and a second shoulder of the at least one wearer. Alternatively, the first strap may cross over the second strap one or more times.

The at least one strap may be formed of any fabric. In some embodiments, the at least one strap may be formed of the same fabric as the first garment or the second garment. In other embodiments, the at least one strap may be formed of a different fabric than the first garment or the second garment. In still other embodiments, the at least one strap may be formed of elastic so as to improve the versatility and adaptability of the first garment to differently-sized bodies of wearers.

The garment suspender may further comprise a first retractable cover and a second retractable cover. The first retractable cover may be configured to at least partially conceal the first clip. Similarly, the second retractable cover may be configured to at least partially conceal the second clip. In certain embodiments, the first retractable cover and the second retractable cover may comprise one or more design elements, such as a bow, lace, or other desirable features.

According to further embodiments, a garment suspender system may comprise a first garment, a second garment, and at least one strap having a first fastener and a second fastener. The first fastener and the second fastener may be configured to connect the first garment to the second garment so as to form-fit, and thereby flatter, a body of at least one wearer. In some embodiments, the at least one strap may be affixed to the first garment, while in others, the at least one strap may overlay the first garment.

The first fastener and the second fastener may comprise any fastening means including clips, buttons, ties, hook-and-loop, or even adhesive. In certain exemplary embodiments, the first fastener and the second fastener may comprise suspender clips, which may effectively secure while not harming the second garment. In addition, the first fastener may comprise a different fastening means than the second fastener.

The garment suspender system may further comprise a first retractable cover and a second retractable cover. The first retractable cover and the second retractable cover may comprise one or more design elements. In this manner, the first retractable cover and the second retractable cover may be configured to at least partially conceal the first fastener and the second fastener, respectively.

One or more of the above-disclosed embodiments, in addition to certain alternatives, are provided in further detail below with reference to the attached figures. The disclosed subject matter is not, however, limited to any particular embodiment disclosed.

Figure 1:
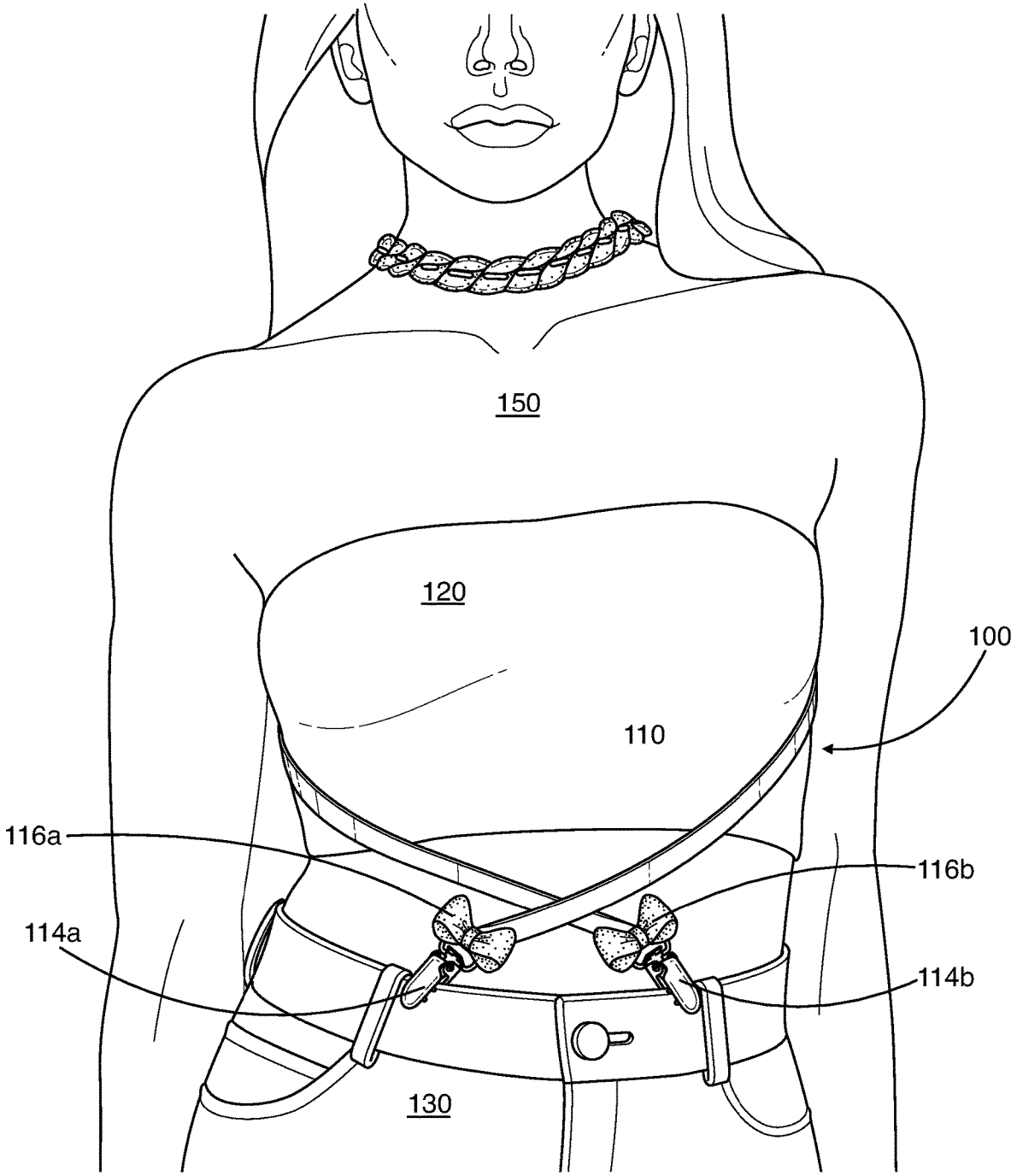
FIG. 1 shows a front view of an embodiment of the garment suspender.

The disclosed embodiments may be better understood by referring to the figures in the attached drawings, as provided below. The attached figures are provided as non-limiting examples for providing an enabling description of the method and system claimed. Attention is called to the fact, however, that the appended drawings illustrate only typical embodiments of this invention and are therefore not to be considered as limiting of its scope. One skilled in the art will understand that the invention may be practiced without some of the details included in order to provide a thorough enabling description of such embodiments. Well-known structures and functions have not been shown or described in detail to avoid unnecessarily obscuring the description of the embodiments.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "couple," "coupled," "couples," "coupling," and the like should be broadly understood and refer to connecting two or more elements or signals, electrically, mechanically or otherwise. Two or more electrical elements may be electrically coupled, but not mechanically or otherwise coupled; two or more mechanical elements may be mechanically coupled, but not electrically or otherwise coupled; two or more electrical elements may be mechanically coupled, but not electrically or otherwise coupled. Coupling (whether mechanical, electrical, or otherwise) may be for any length of time, e.g., permanent or semi-permanent or only for an instant.

DETAILED DESCRIPTION

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications and equivalents included within the spirit and scope of the disclosure as defined by the appended claims.

With reference to FIG. 1, a garment suspender 100 may comprise at least one strap 110, a first clip 114*a*, and a second clip 114*b*. The at least one strap 110 may have a first end 112*a* and a second end 112*b*. The first clip 114*a* may be disposed at the first end 112*a* and the second clip 114*b* may be disposed at the second end 112*a*.

The at least one strap 110 may be configured to connect a first garment 120 to a second garment 130 and may, therefore, be formed of any suitable material. In some embodiments, the at least one strap is formed of any fabric. In certain exemplary embodiments, the at least one strap 110 may be formed of elastic. In such embodiments, the garment suspender 100 may be worn by a wider variety of differently-sized wearers.

One advantage of the present disclosure is that the garment suspender 100 may be incorporated into the design of the first garment 120 and as such, the at least one strap 110 may be formed of any fabric that may complement the first garment 120. In some embodiments, the at least one strap 110 may be formed of the same fabric or other material as the first garment 120. Alternatively, the at least one strap may be formed of a fabric or other material that is different from the first garment 120.

As shown in FIGS. 1-5, the first garment 120 may be a garment top, such as a shirt, blouse, sweater, or other clothing intended to be worn on the upper body of the at least one wearer 150. Similarly, the second garment 130 may be a garment bottom, such as pants, shorts, a skirt, or other clothing intended to be worn on the lower body of the at least one wearer 150. However, in alternative embodiments not shown in the FIGS., the first garment 120 may be the garment bottom and the second garment 130 may comprise footwear, such as socks or shoes. In still further embodiments not shown in the FIGS., the first garment 120 may comprise headwear, such as a hat or sunglasses, and the second garment 130 may comprise the garment top. Thus, it will be understood that, while the first garment 120 and the second garment 130 may be depicted herein as the garment top and the garment bottom, respectively, the first garment 120 and the second garment 130 may comprise any other type of clothing.

Figure 2:
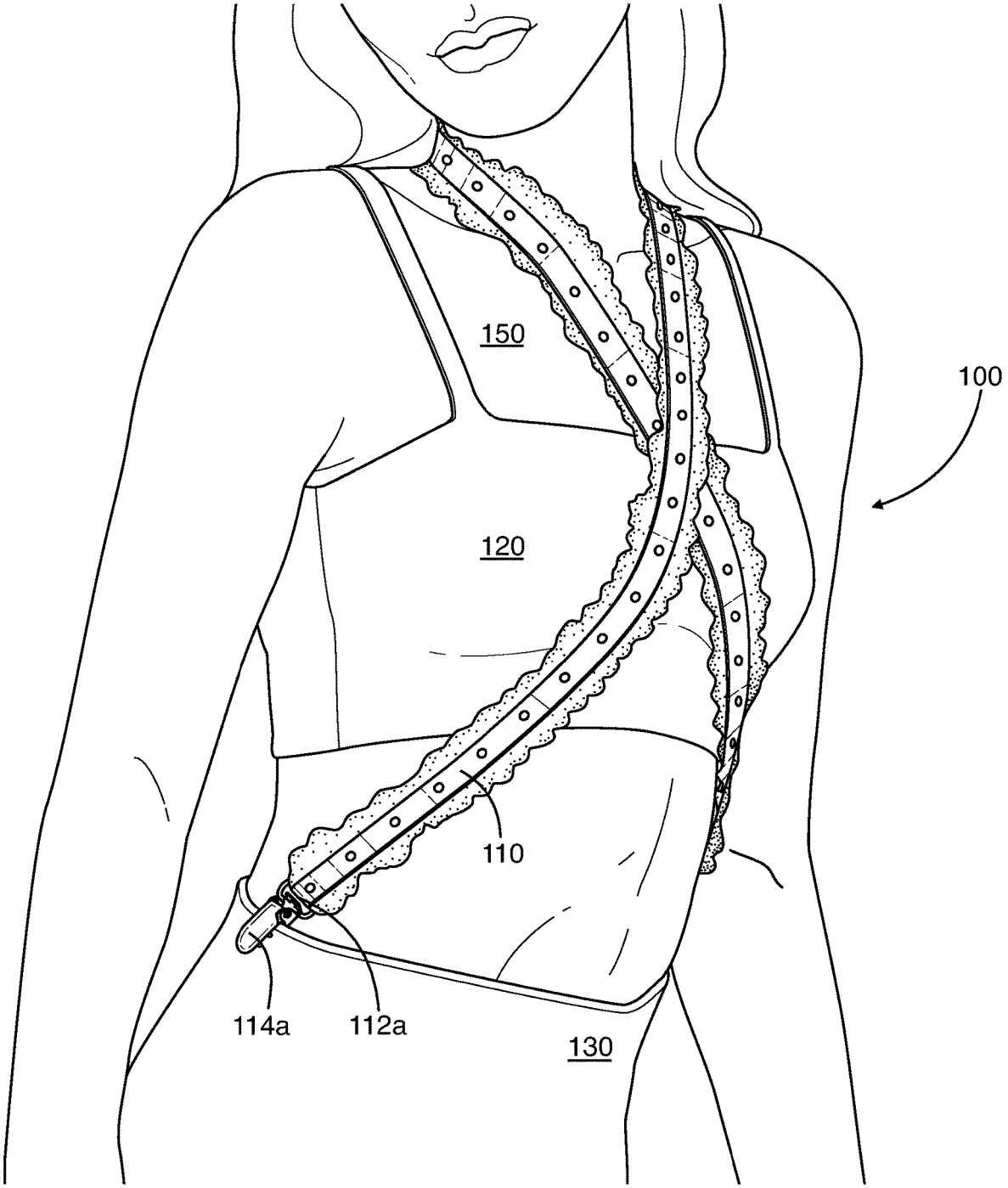
FIG. 2 shows a perspective view of an embodiment of the garment suspender.

As shown in FIGS. 1 and 2, the at least one strap 110 may convertibly overlay the first garment 120 such that the garment suspender 100 may remain unaffixed to the first garment 120. In such embodiments the garment suspender 100 may be usable with virtually any garment. Moreover, the garment suspender 100 may be variously used with the first garment 120. For instance, as shown in FIG. 1, the at least one strap 110 may wrap around the neck, along the rear upper body, and cross along the front upper body of the at least one wearer 150. As another example shown in FIG. 2, the at least one strap 110 may wrap around the rear neck, cross along the front upper body, and terminate along the side upper body of the at least one wearer 150. In this manner, the garment suspender 100 may be convertible in manner of use along the body of the at least one wearer 150. The embodiments illustrated in the FIGS. are mere examples and should not be construed to limit the disclosure. It will be understood that the garment suspender 100 may be wrapped along or around the body of the at least one wearer 150 in virtually any desirable manner, which may differ between wearers.

Figure 3:
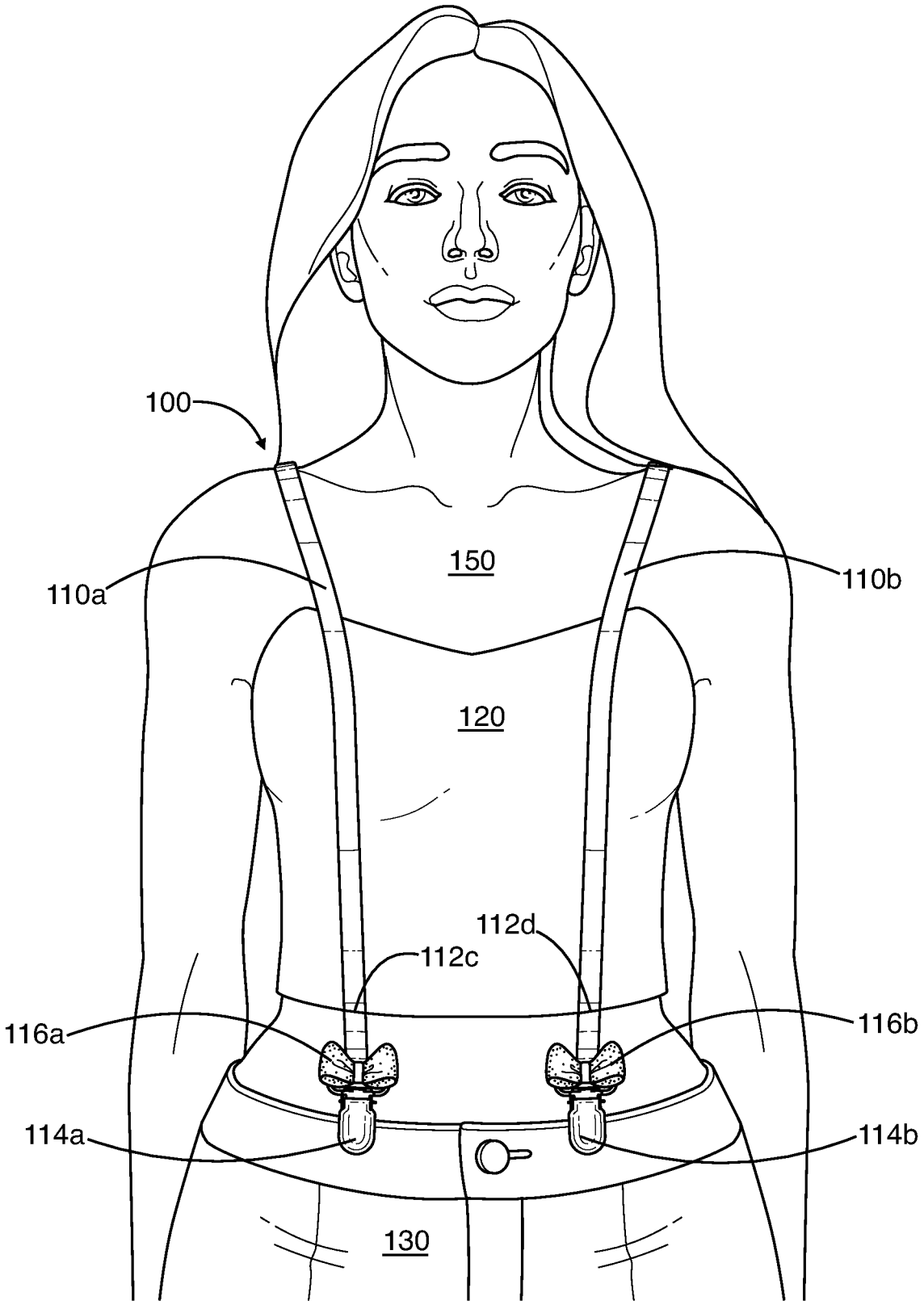
FIG. 3 shows a front view of an embodiment of the garment suspender.
Figure 13:
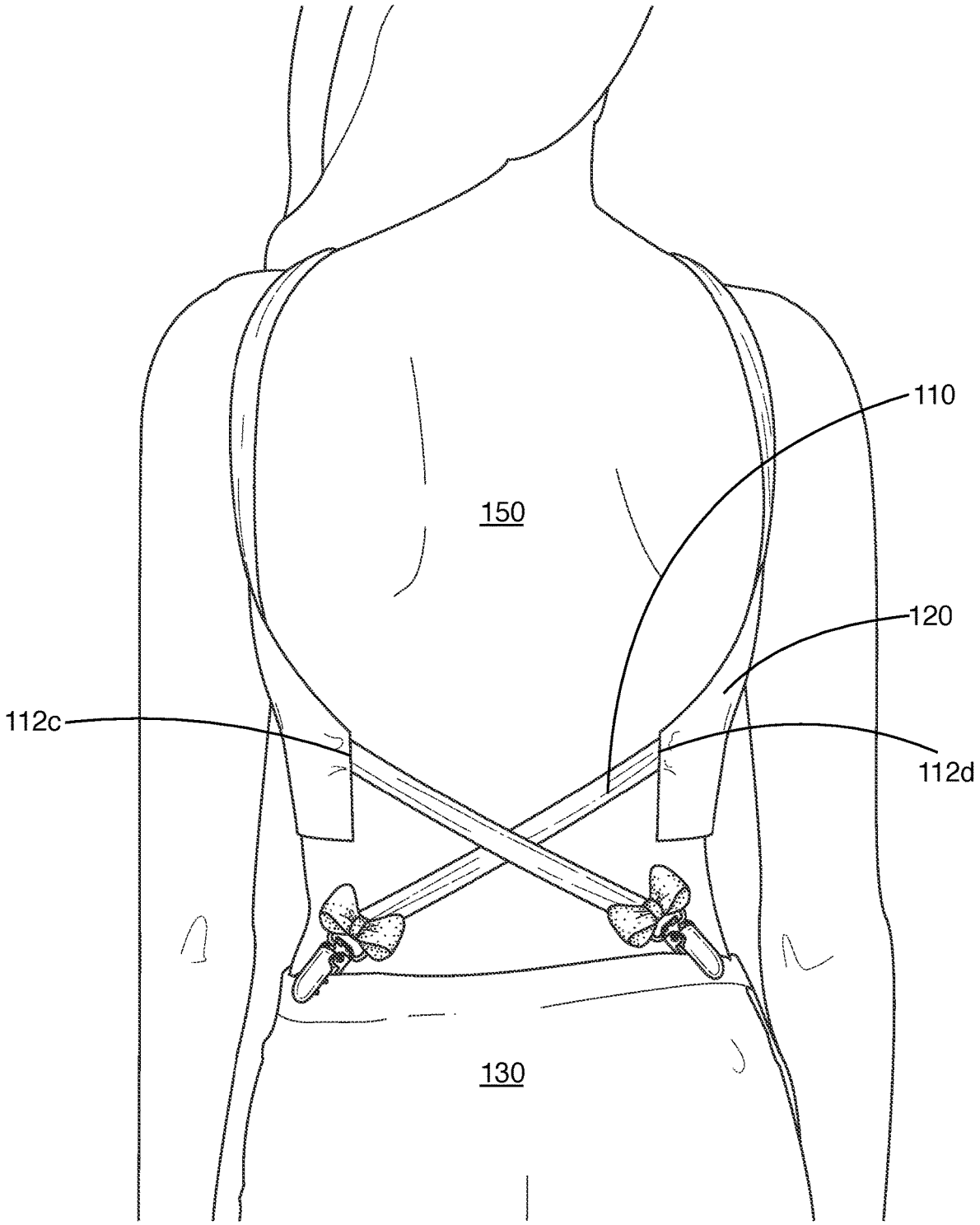
FIG. 13 shows a rear view of an embodiment of the garment suspender.

Alternatively, as shown in FIGS. 3 and 13, the at least one strap 110 may be affixed to the first garment 120. For instance, as shown in the FIGS. 3 and 13, the at least one strap 110 may further comprise a third end 112*c* and a fourth end 112*d* which may be permanently affixed to the first garment 120. In these embodiments, the garment suspender 100 may be permanently incorporated into the design of the first garment 120. In this way, it will be understood that the garment suspender 100 may be permanently incorporated along any portion of the first garment 120. Moreover, the garment suspender 100 may be clippable to the second garment 130 along a front portion, a rear portion, a side portion, or anywhere along the second garment 130 so as to securely affix the first garment 120 to the second garment 130.

Figure 4:
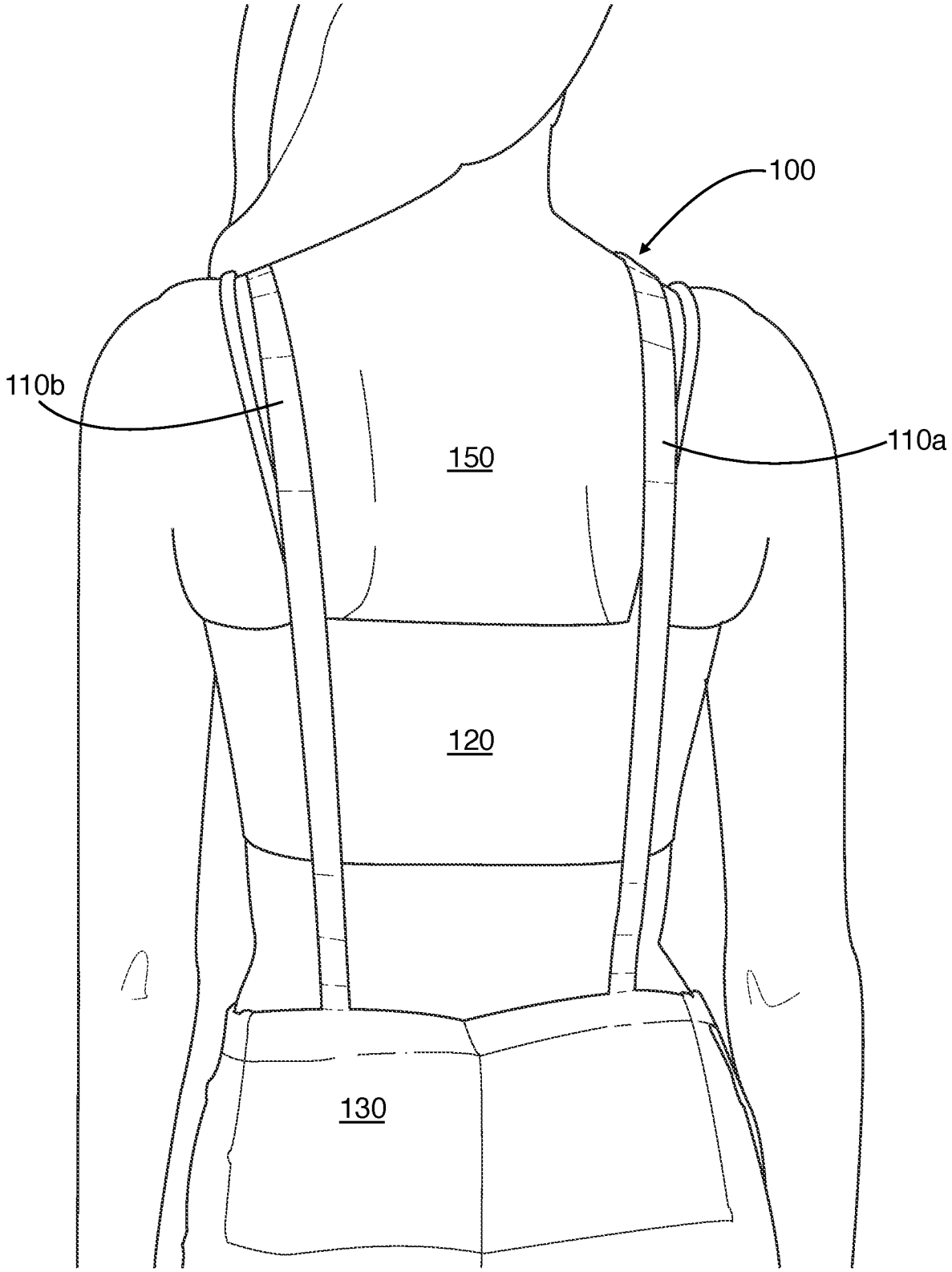
FIG. 4 shows a rear view of an embodiment of the garment suspender.

In further embodiments, as shown in FIG. 4, the at least one strap 110 may be permanently affixed to the second garment. In such embodiments, the garment suspender 100 may be permanently incorporated into the design of the second garment 130. For example, as shown in FIG. 4, the at least one strap 110 may be permanently affixed to the rear portion of the second garment 130. Alternatively, the at least one strap may be permanently affixed to a front or other portion of the second garment 130.

In some embodiments, such as that shown in FIGS. 1-2, the at least one strap 110 may comprise a single strap. In other embodiments, including as shown in FIGS. 3-4, the at least one strap 110 may comprise a first strap 110*a* and a second strap 110*b*. The first strap 110*a* may be disposed parallelly to the second strap 110*b* such that the first strap 110*a* may be placed along a first shoulder and the second strap 110*b* may be placed along a second shoulder of the at least one wearer 150. The first strap 110*a* and the second strap 110*b* have a top portion unfixed to the first garment 120, which extends around the first and second shoulder of the wearer, respectively, a middle portion affixed to the first garment 120, and the first end 112*a* and second end 112*b*, opposite the top portion, that are unfixed to the first garment 120. In still other embodiments not shown in the FIGS., the first strap 110*a* and the second strap 110*b* may intersect.

As shown in FIGS. 1-3, the first clip 114*a* and the second clip 114*b* may connect the first garment 120 to the second garment 130 by removably affixing the first clip 114*a* and the second clip 114*b* to the second garment 130. In this manner, the first clip 114*a* and the second clip 114*b* may secure the second garment 130 so as to form-fit the body of the at least one wearer 150. Referring specifically to FIG. 4, the first clip 114*a* may clip along an edge of the second garment 130.

Figure 5:
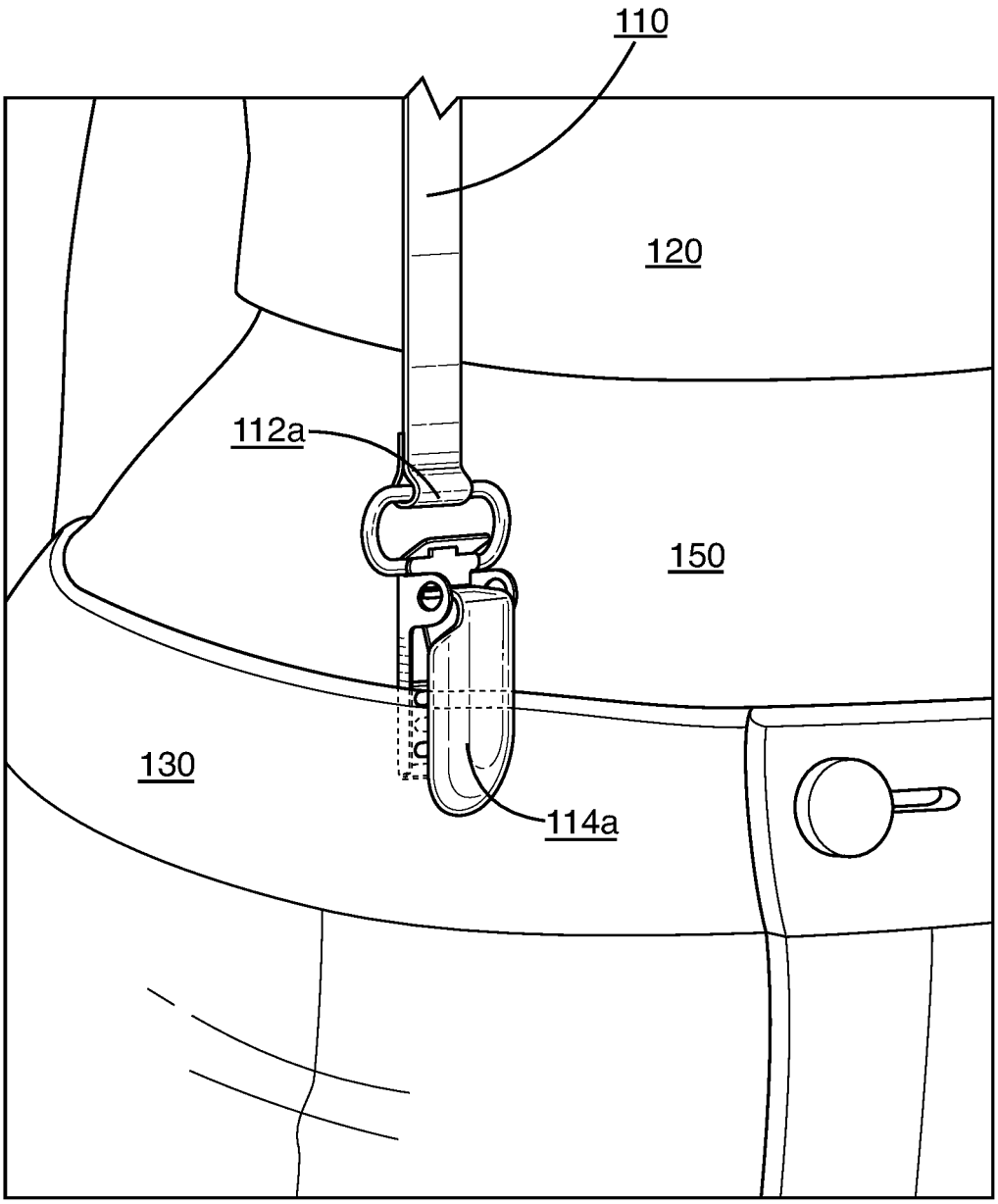
FIG. 5 shows a front view of an embodiment of the garment suspender.
Figure 6:
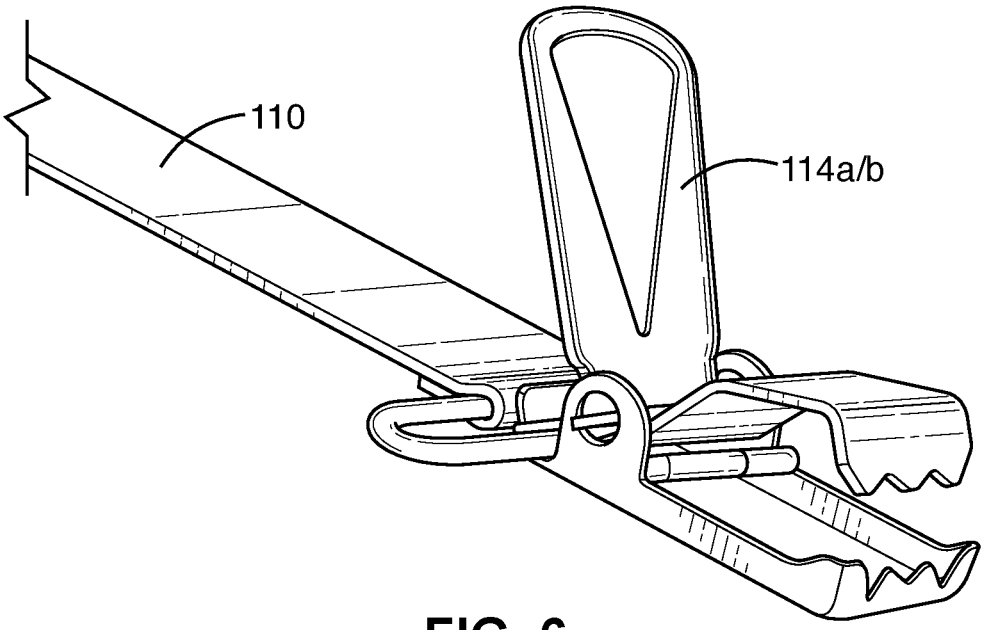
FIG. 6 shows a perspective view of an embodiment of the garment suspender.
Figure 7:
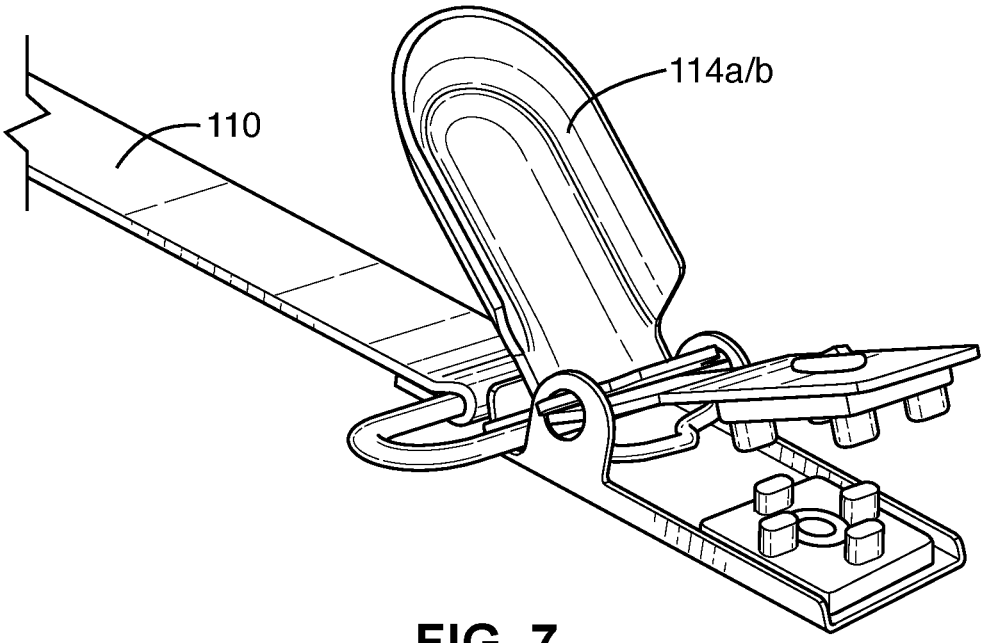
FIG. 7 shows a perspective view of an embodiment of the garment suspender.
Figure 8:
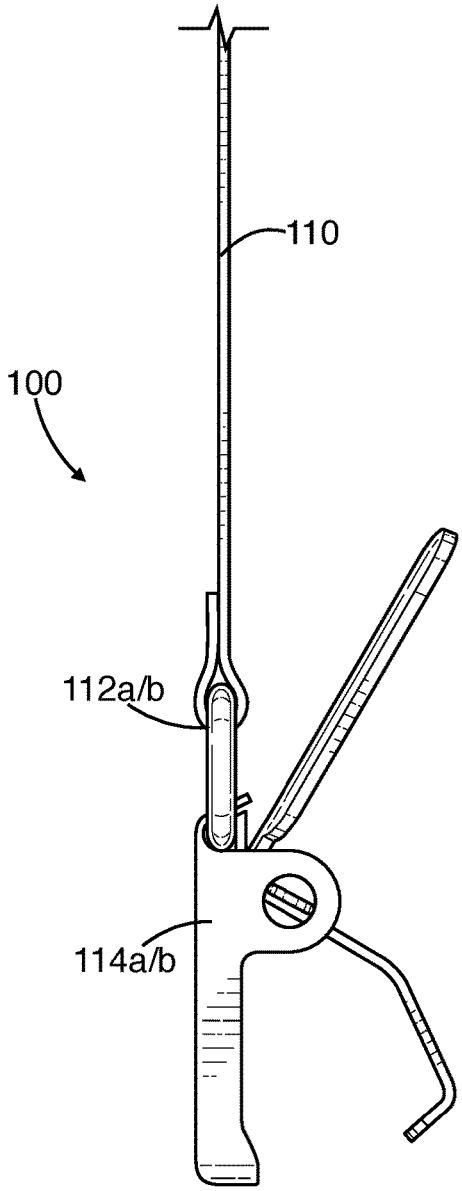
FIG. 8 shows a side view of an embodiment of the garment suspender.
Figure 9:
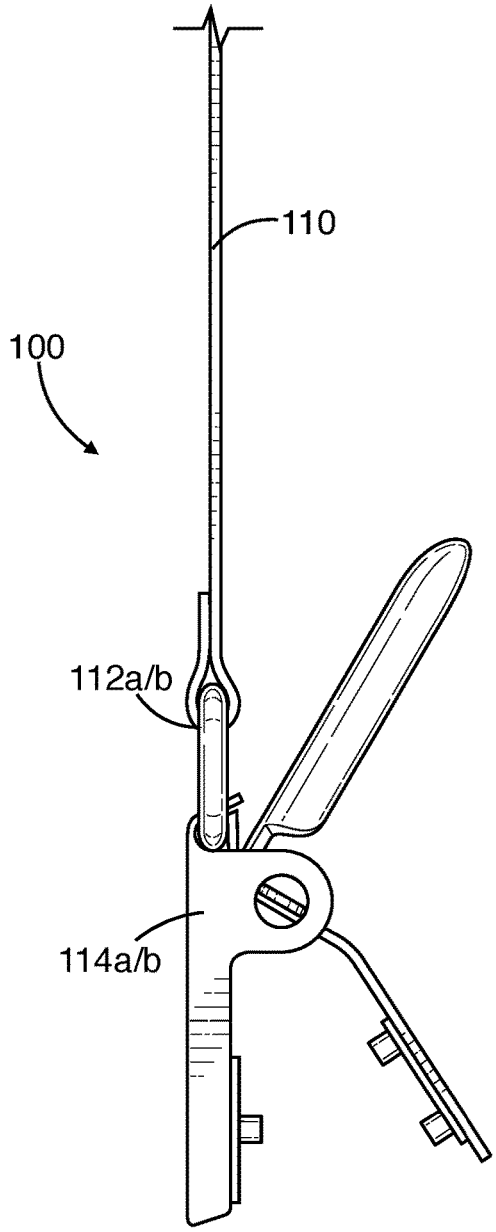
FIG. 9 shows a side view of an embodiment of the garment suspender.
Figure 10:
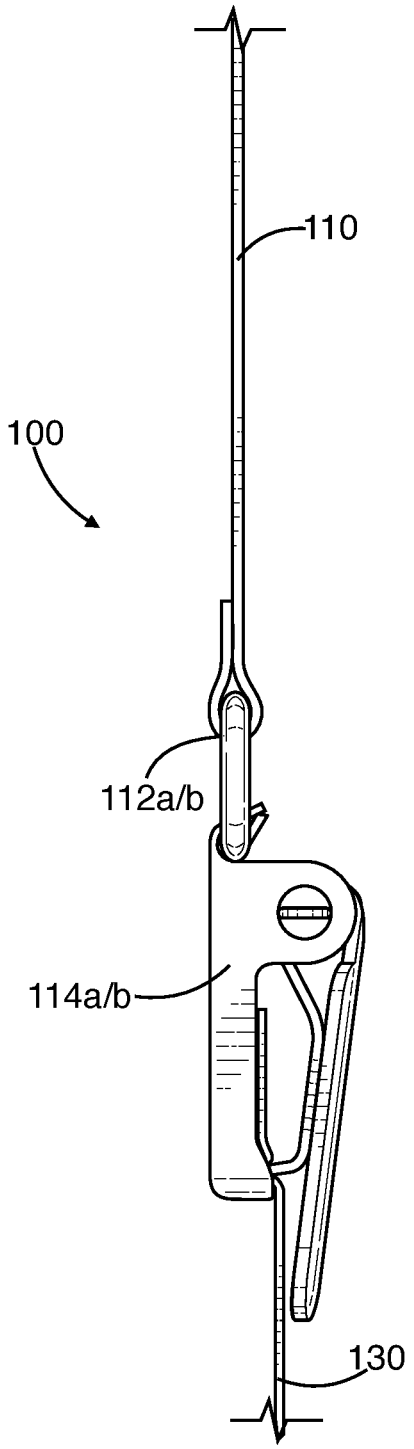
FIG. 10 shows a side view of an embodiment of the garment suspender.

In accordance with certain exemplary embodiments, the first clip 114*a* and the second clip 114*b* may comprise any type of clip. As shown in the FIGS., the first clip 114*a* and the second clip 114*b* may be suspender clips. More particularly, as shown in FIGS. 5, 7, and 9, the first clip 114*a* and the second clip 114*b* may comprise construction (or "alligator") clips. Alternatively, as shown in FIGS. 6, 8, and 10, the first clip 114*a* and the second clip 114*b* may comprise finger clips. Construction clips and finger clips may be desirable because of the ability to tightly secure while not harming or otherwise interfering with the second garment 130. In still other embodiments not shown in the FIGS., the first clip 114*a* and the second clip 114*b* may comprise drop clips, trigger snaps, leather button-on, fabric button-on, belt clips, convertible attachment, industrial button-on, or belt loop.

Despite being referred to as "clips" throughout this disclosure, the first clip 114*a* and the second clip 114*b* may comprise any fastening means. For instance, the first clip 114*a* and the second clip 114*b* may comprise buttons, adhesive, hook-and-loop fasteners, ties, or a combination of fastening means. As a result, a person of ordinary skill in the art will recognize that the present disclosure should not be limited to the embodiments illustrated and discussed herein.

Figure 11:
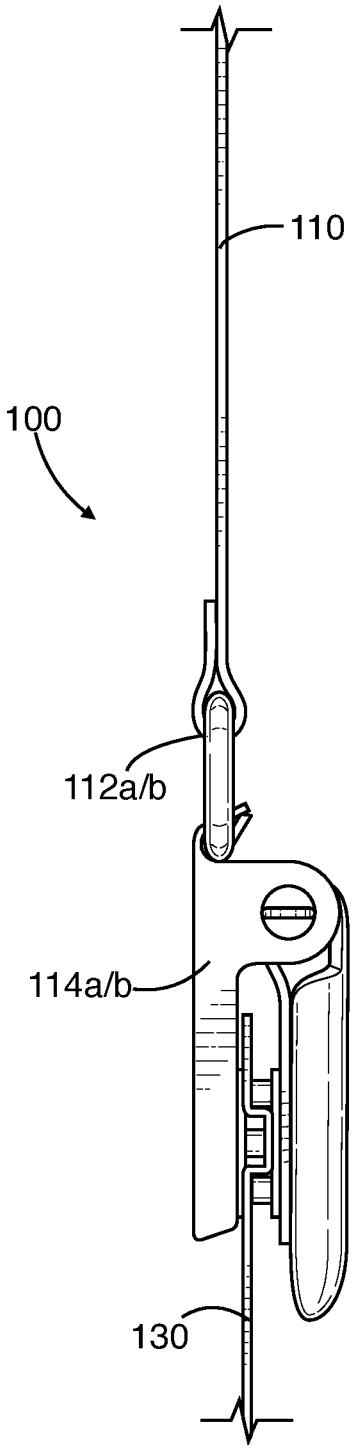
FIG. 11 shows a side view of an embodiment of the garment suspender.
Figure 12:
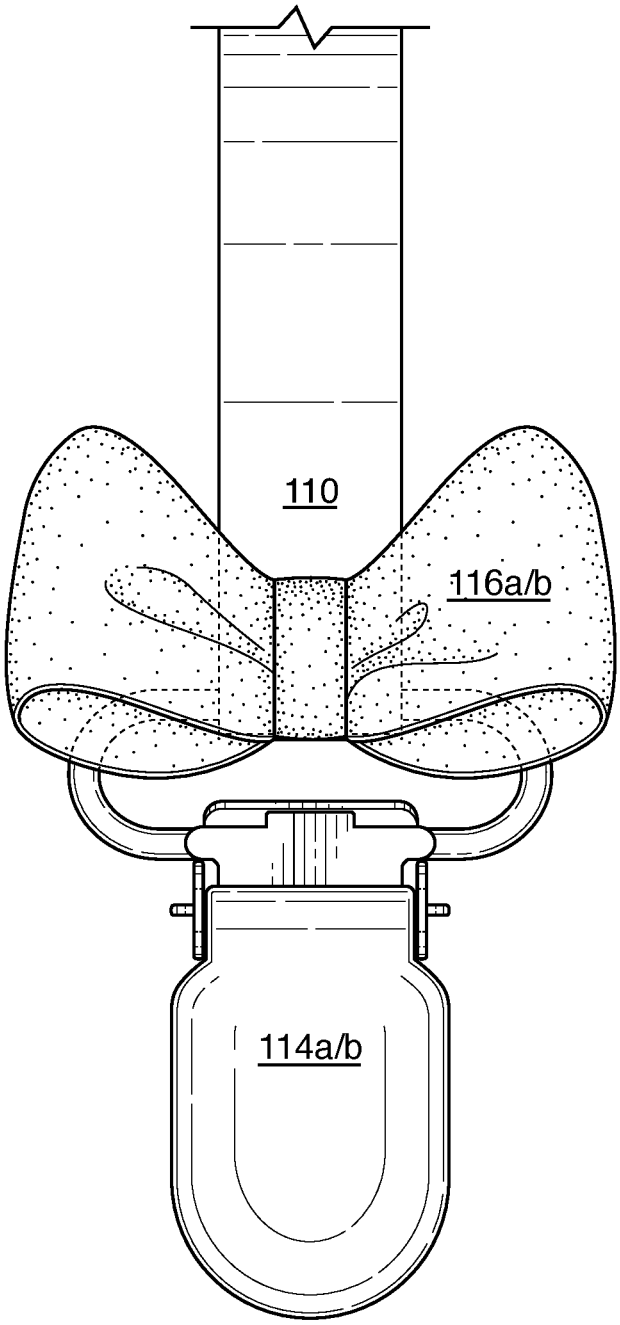
FIG. 12 shows a front view of an embodiment of the garment suspender.

In further embodiments, such as illustrated in FIG. 11, the garment suspender 100 may also comprise a first retractable cover 116*a* and a second retractable cover 116*b*. The first retractable cover 116*a* and the second retractable cover 116*b* may be configured to at least partially conceal the first clip 114*a* and the second clip 114*b*, respectively. While, as shown in FIG. 11, the first retractable cover 116*a* and the second retractable cover 116*b* may only partially conceal the first clip 114*a* and the second clip 114*b*, in other embodiments, the first retractable cover 116*a* and the second retractable cover 116*b* may fully conceal the first clip 114*a* and the second clip 114*b*.

The first retractable cover 116*a* and the second retractable cover 116*b* may comprise one or more design elements. As shown in FIGS. 1, 3, and 11, the one or more design elements may comprise a bow. In alternative embodiments, the first retractable cover 116*a* and the second retractable cover 116*b* may each comprise a decorative sleeve. Moreover, the one or more design elements may comprise different types of fabric, jewels, symbols, or other ornamentations.

Referring back to FIGS. 1-5, a garment suspender system 100 may comprise a first garment 120, a second garment 130, and at least one strap 110. The at least one strap may comprise a first fastener 114*a* and a second fastener 114*b* disposed at a first end 112*a* and a second end 112*b*, respectively. The garment suspender system 100 may create more sizing and, in some embodiments, style diversity within a single garment, such as the first garment 120. In this way, the first garment 120 may better form fit a wider range of body types and ultimately, appear more flattering.

The first garment 120 may comprise any garment, including a garment top, a garment bottom, or even, headwear. The second garment 130 may also comprise any garment including the garment bottom, or even, footwear. In the embodiments illustrated in FIGS. 1-5, the first garment 120 is the garment top and the second garment 130 is the garment bottom.

According to certain embodiments, the at least one strap 110 may comprise a single strap or a plurality of straps. FIGS. 1-2 illustrate an embodiment where the at least one strap 110 may comprise the single strap, which may be worn in a variety of manners, as described above. FIG. 3 illustrates embodiments where the at least one strap may comprise a first strap 110*a* and a second strap 110*b*.

The at least one strap 110 may be removably or permanently affixed to the first garment 120. In these embodiments, the at least one strap may be incorporated into the design of the first garment 120 and may therefore be formed of a similar, complementary, or different fabric that the first garment 120. Alternatively, the at least one strap 110 may convertibly overlay the first garment 120. In such embodiments, the at least one strap 110 may overlay the first garment 120 so as to flatter or as desired by the at least one wearer 150.

The first fastener 114*a* and the second fastener 114*b* of the at least on strap 110 may be configured to connect the first garment 120 to the second garment 130 so as to form-fit the body of the at least one wearer 150. The first fastener 114*a* and the second fastener 114*b* may comprise any fastening means. In some embodiments, including as shown in greater detail in FIGS. 5-11, the first fastener 114*a* and the second fastener 114*b* may comprise suspender clips, such as construction clips or finger clips.

Referring to FIGS. 1, 3, and 11, in additional embodiments, the garment suspender system 100 may further comprise a first retractable cover 116*a* and a second retractable cover 116*b*, which may at least partially conceal the first fastener 114*a* and the second fastener 114*b*. The first retractable cover 116*a* and the second retractable cover 116*b* may comprise one or more design elements, such as the bow shown in the FIGS., or any other ornamentation.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

CONCLUSIONS, RAMIFICATIONS, AND SCOPE

While certain embodiments of the invention have been illustrated and described, various modifications are contemplated and can be made without departing from the spirit and scope of the invention. For example, the first clip, the first fastener, the second clip, and the second fastener may be suspender clips, or virtually any other fastening means. Accordingly, it is intended that the invention not be limited, except as by the appended claim(s).

The teachings disclosed herein may be applied to other systems, and may not necessarily be limited to any described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions and concepts of the various references described above to provide yet further embodiments of the invention.

Particular terminology used when describing certain features or aspects of the invention should not be taken to imply that the terminology is being refined herein to be restricted to any specific characteristics, features, or aspects of the garment suspender with which that terminology is associated. In general, the terms used in the following claims should not be constructed to limit the garment suspender to the specific embodiments disclosed in the specification unless the above description section explicitly define such terms. Accordingly, the actual scope encompasses not only the disclosed embodiments, but also all equivalent ways of practicing or implementing the disclosed system, method and apparatus. The above description of embodiments of the garment suspender is not intended to be exhaustive or limited to the precise form disclosed above or to a particular field of usage.

While specific embodiments of, and examples for, the method, system, and apparatus are described above for illustrative purposes, various equivalent modifications are possible for which those skilled in the relevant art will recognize.

While certain aspects of the method and system disclosed are presented below in particular claim forms, various aspects of the method, system, and apparatus are contemplated in any number of claim forms. Thus, the inventor reserves the right to add additional claims after filing the application to pursue such additional claim forms for other aspects of the garment suspender.

What is claimed is:

1. A garment suspender comprising at least one strap;

wherein a top portion of the at least one strap is unfixed to a garment top and configured to extend around a shoulder;

wherein a middle portion of the at least one strap is permanently affixed to and externally visible as an integrated part of the garment top and configured to connect the garment top to a garment bottom;

wherein a first end and a second end of the at least one strap are opposite the top portion of the at least one strap and unfixed to the garment top;

a first clip disposed at the first end of the at least one strap;

a second clip disposed at the second end of the at least one strap; and wherein the at least one strap is configured to directly act upon portions of the garment top itself, such that adjustably securing the first and second clips to a garment bottom enables selective reduction of slack from the garment top around a wearer's body to alternatively form-fit a plurality of differently sized wearers.

2. The garment suspender of claim 1, further comprising a first retractable cover configured to at least partially conceal the first clip;

a second retractable cover configured to at least partially conceal the second clip.

3. The garment suspender of claim 1, wherein the first clip and the second clip are suspender clips.

4. The garment suspender of claim 1, wherein the at least one strap is formed of elastic.

5. A garment suspender system, comprising a first garment;

a second garment; and at least one strap;

wherein a top portion of the at least one strap is unfixed to the first garment and configured to extend around a shoulder;

wherein a middle portion of the at least one strap is affixed to and externally visible as an integrated part of the first or second garment and having a first fastener and a second fastener configured to connect the first garment to the second garment wherein a first end and a second end of the first and second fastener, respectively, are opposite the top portion of the at least one strap and unfixed to the first garment; and and further configured to directly act upon portions of such first or second garment affixed to the at least one strap, such that adjustably securing the first and second fasteners to the second garment effectuates selective reduction of slack from the garment top around a wearer's body so as to alternatively form-fit a plurality of differently sized wearers.

6. The garment suspender system of claim 5, wherein the first garment is a garment top and the second garment is a garment bottom.

7. The garment suspender system of claim 5, wherein the first fastener and the second fastener are suspender clips.

8. The garment suspender system of claim 5, further comprising a first retractable cover configured to at least partially conceal the first fastener;

a second retractable cover configured to at least partially conceal the second fastener.

9. The garment suspender of claim 5, wherein the at least one strap is formed of elastic.

* * * * *